United States Patent [19]

Sullivan

[11] 4,031,689

[45] June 28, 1977

[54] FLEXIBLE BAG SUPPORTING DEVICE

[76] Inventor: Philip E. Sullivan, c/o Columbia Poly Pak Company, 83 Meadow St., Hartford, Conn. 06114

[22] Filed: Sept. 18, 1975

[21] Appl. No.: 614,515

[52] U.S. Cl. ..... 53/370; 53/390; 248/97; 248/99; 248/349

[51] Int. Cl.[2] ..... B65B 7/12; B65B 51/00; B65B 67/12

[58] Field of Search ..... 53/370, 390; 248/97, 248/99, 349

[56] References Cited

UNITED STATES PATENTS

| | | | |
|---|---|---|---|
| 1,762,475 | 6/1930 | Hirsch | 248/99 |
| 2,898,163 | 8/1959 | McMahan, Sr. | 248/349 X |
| 3,140,070 | 7/1964 | Doebele | 248/99 X |
| 3,161,391 | 12/1964 | Bahnsen | 248/99 |
| 3,222,019 | 12/1965 | Weisberg | 248/97 |
| 3,629,992 | 12/1971 | Price et al. | 53/370 |
| 3,737,129 | 6/1973 | Foster | 248/99 X |
| 3,768,763 | 10/1973 | Hembree | 248/99 X |

*Primary Examiner*—Othell M. Simpson
*Assistant Examiner*—Horace M. Culver
*Attorney, Agent, or Firm*—Prutzman, Hayes, Kalb & Chilton

[57] ABSTRACT

A device is provided for conveniently holding a flexible bag open and extended so as to be filled and which is particularly designed to enable a user to quickly and easily form a tightly twisted closure for removal of a loaded bag. The device features a base upon which a support platform and stand are rotatably mounted with the stand having a wirelike frame construction promoting access to a loaded bag for efficient removal from the support platform upon spinning the bag to form an open top of the bag into a tightly wound closure serving as a handle for the bag.

2 Claims, 3 Drawing Figures

FIG. 1
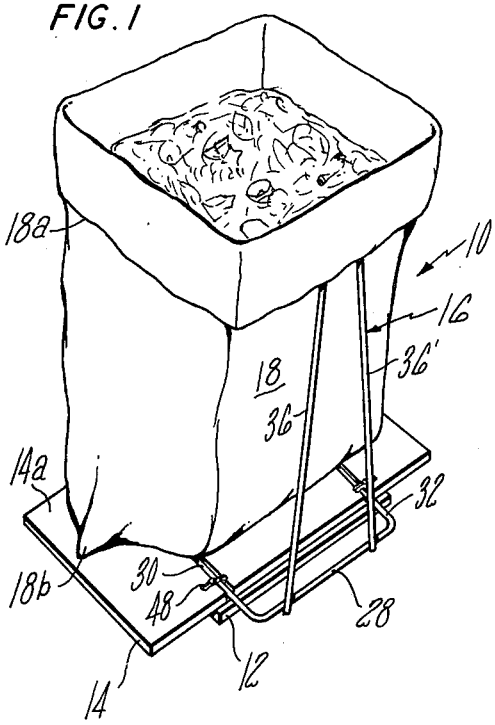
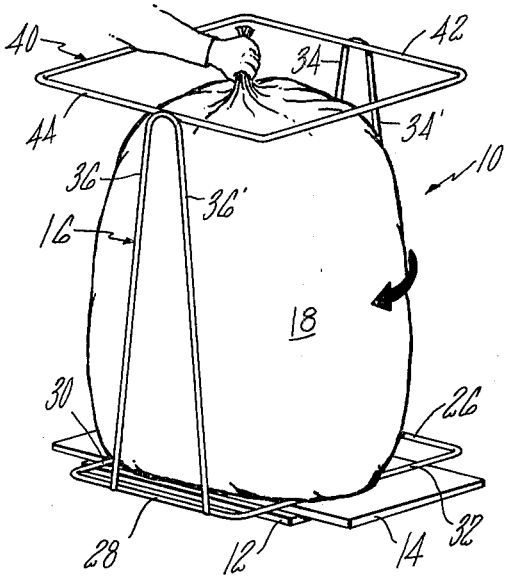
FIG. 2
FIG. 3
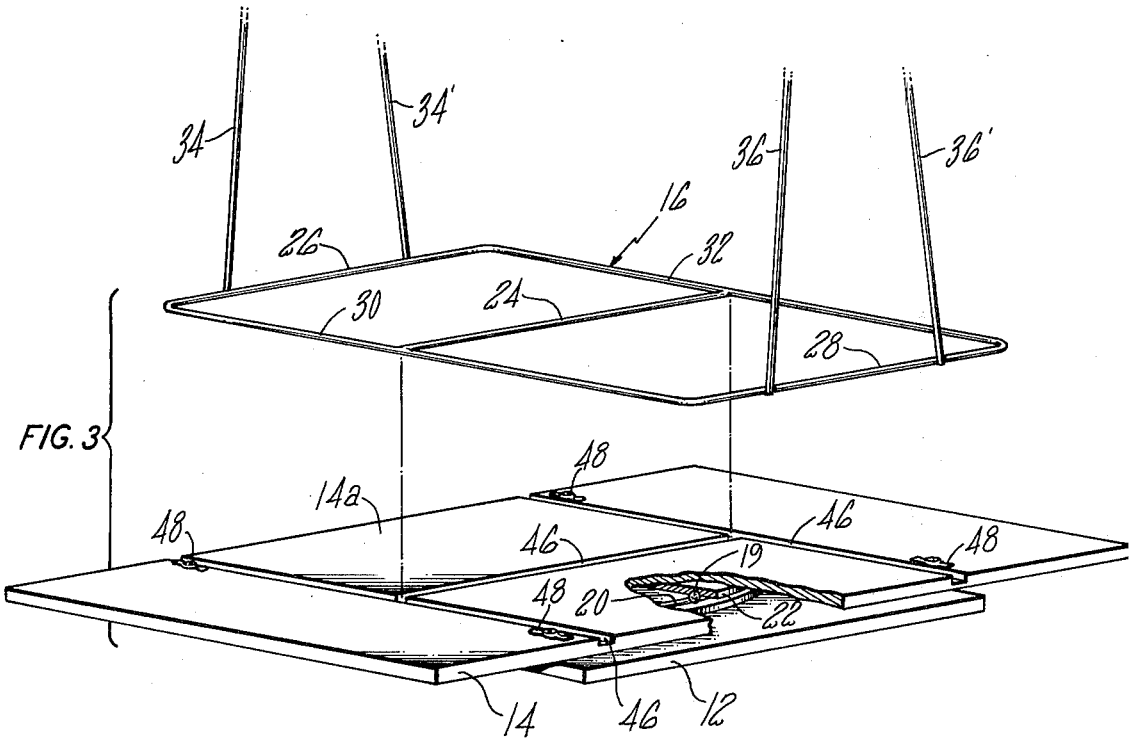

FLEXIBLE BAG SUPPORTING DEVICE

This invention relates to a support device for holding a flexible bag open for loading.

A primary object of this invention is to provide a new and improved flexible bag support device particularly designed to not only hold open the bag for quick and easy loading, but to serve as an easily handled unit for supporting the bag for spinning to effect a tightly twisted closure of its normally open top.

Another object of this invention is to provide such a device of the type described which is of a rugged lightweight portable construction which is easily handled and operated and which is usable over an extended service life.

Other objects will be in part obvious and in part pointed out more in detail hereinafter.

A better understanding of this invention will be obtained from the following detailed description and the accompanying drawing of an illustrative application of the invention.

IN THE DRAWING

FIG. 1 is an isometric view of a device incorporating this invention with a bag shown as being mounted thereon in an operative position;

FIG. 2 is an isometric view of the device showing a bag being formed into a twisted closure before its top is secured and the bag is removed from the device; and FIG. 3 is an enlarged isometric view, partly broken away, showing a bottom portion of the bag support structure.

Referring to the drawing in detail, a device 10 is disclosed having a base 12 constructed of any suitable rigid material such as wood, metal or plastic with a support platform 14 formed of similar material and a stand 16 mounted on the base 12. To provide a bag support device 10 which is not only of particular utility in accommodating quick and easy collection of debris and the like in a flexible bag such as at 18 which is notoriously awkward and cumbersome to fill, but which device 10 is designed to facilitate closure of a loaded bag, the support platform 14 and stand 16 are mounted in fixed relation to one another for rotation as a unit on the base 12.

While the specific construction of the means supporting the rotary platform on its base 12 may take a variety of different forms, the specifically illustrated embodiment of this invention is shown having bearing balls 19 operatively positioned within races 20 and 22 mounted respectively on confronting faces of the base 12 and platform 14.

To provide an economical and readily fabricated bag holding stand, this invention features an open frame construction formed of wire or similar wirelike members such as tubing, e.g., having a rectangular bottom frame formed with an intermediate brace 24 parallel to opposite side members 26, 28 all of which are shown in the drawing as being secured to connecting feet 30 and 32. Each side member 26 and 28 has a pair of upright legs 34, 34' and 36, 36' interconnecting the frame with a bag mounting rim 40 which corresponds generally to the configuration of the bottom frame of the stand 16 and which is configured and dimensioned to correspond to an open top of a bag 18 such as the commercially available plastic trash bags.

More specifically, the rim 40 is shown as an open rectilinear wire frame structure having two opposite sides 42 and 44 secured respectively to the legs 34, 34' and 36, 36' with the legs supporting the rim 40 of the stand 16 at a predetermined height. The height of the rim 40 is less than the height of the bag 18 which is to be supported. By virtue of this construction, the open top of the bag 18 may be reversely folded in an extended open condition over the top of rim 40 with the bottom of the bag resting on support platform 14. Accordingly, the bag top is conveniently held open to permit debris or any other material which is to be collected to be disposed in the bag 18 without requiring it to be manually handled.

The disclosed open frame construction of the stand 16 permits the commercially available flat plastic bag 18 to be quickly and easily mounted, preferably with substantial overhang of the reverse fold **18*a* over the rim 40 of the stand 16, e.g., with approximately 10 inches of overhang, and with the bottom opposite corners (such as 18*b*) of the bag 18 so positioned that the bag 18 extends over the feet 30, 32 of the bottom frame of the stand 16 intermediate the opposite pairs of legs 34, 34' and 36, 36'.**

To securely install the stand 16 on the platform 14, the upper face **14*a* of the platform 14 is shown having slots 46 to receive the feet 30, 32 and intermediate brace 24 of the bottom frame of the stand 16. The stand 16 is shown removably secured to the platform 14 by releasable locking members such as the illustrated wing fasteners 48. These fasteners 48 are mounted on the platform 14 for pivotal movement between a release position in noninterfering relation to the bottom feet 30, 32 and a lock position overlying the feet 30, 32 when disposed within their respective slots 46 in platform 14.**

With the stand 16 installed on the platform 14 and a bag 18 mounted on the stand 16 in condition to be removed, the device 10 of this invention provides for quick and easy closure and removal of the loaded bag 18.

I.e., the open bag top is simply unfolded from the rim 40 and the top of the bag 18 is gathered or drawn together and manually held fixed such that upon spinning the bag 18, the weight of its contents rotates the platform 14, stand 16 and bag 18 upon the base 12 to tightly twist the bag top into a closure.

The closure thus effected at the top of the bag 18 comprises several layers of plastic which collectively are stronger than one layer and form a so-called "ponytail" which can then be secured by any suitable means such as the well-known commercially available wire-reinforced plastic or paper bag ties (not shown) which are quickly and easily attached to secure the bag 18.

The "ponytail" thus formed by the structure of this invention additionally serves as a handle for the bag 18 which optimizes the extraordinary tensile strength of certain conventional bag materials such as polyethylene and minimizes breakage of such bags upon lifting them for removal and disposal.

The bag 18 may accordingly be removed conveniently from an open side of the stand 16 due to its previously disclosed open wire frame construction. That is, the top of the secured bag 18 is simply withdrawn from below the open top of the stand 16 between its rim 40 and bottom frame. The bag is then lifted by its "ponytail" handle with the several layers of plastic comprising the twisted closure and handle serving to permit removal and lifting of the bag with maximum efficiency, but without the bag being split or damaged as frequently occurs with plastic bags having low puncture resistance, thereby even permitting use of a thinner than normal gauge bag with reduced breakage and cost to the user.

As will be apparent to persons skilled in the art, various modifications, adaptations and variations of the foregoing specific disclosure can be made without departing from the teachings of this invention.

I claim:

1. For use with a flexible bag having a bottom closed end and an upper open end, a bag supporting device comprising a base, a support platform mounted for rotation on the base for supporting the closed end of the bag, a stand of an open wirelike frame construction having a bag mounting rim, a bottom member and upright legs connecting opposite sides of the bottom member to the bag mounting rim of the stand to locate the bag mounting rim in elevated relation to the platform at a height less than the height of the bag to be supported such that the upper end of the bag may be reversely folded over the rim with the bag open and extended for loading, and mounting means for securing the bottom member of the stand in fixed relation to the support platform, the support platform and the stand being rotatable in unison relative to the base such that upon spinning the bag and stand on the support platform while holding the upper end of the bag fixed, its upper end may be formed into a tightly twisted closure and handle for efficient removal and lifting of the bag, the platform having a face scored with a plurality of slots conforming to the configuration of the open wirelike bottom member of the stand for receiving the same in a stabilized assembly, the mounting means removably securing the bottom member of the stand in the slots of the support platform.

2. The device of claim 1 wherein the open wirelike frame construction of the stand comprises legs on only two corresponding sides of the bottom member and the bag mounting rim with the stand being completely open intermediate the legs between the bottom member and the rim for quick and easy removal of a loaded bag from the support platform.

* * * * *